US010076783B2

(12) United States Patent
Tajima et al.

(10) Patent No.: US 10,076,783 B2
(45) Date of Patent: Sep. 18, 2018

(54) METHOD FOR CONTINUOUS-CASTING SLAB

(71) Applicant: NIPPON STEEL & SUMITOMO METAL CORPORATION, Tokyo (JP)

(72) Inventors: Naoki Tajima, Kashima (JP); Akihiro Yamanaka, Tokyo (JP); Kenji Taguchi, Kashima (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/307,854

(22) PCT Filed: May 12, 2015

(86) PCT No.: PCT/JP2015/063585
§ 371 (c)(1),
(2) Date: Oct. 31, 2016

(87) PCT Pub. No.: WO2015/174395
PCT Pub. Date: Nov. 19, 2015

(65) Prior Publication Data

US 2017/0050239 A1 Feb. 23, 2017

(30) Foreign Application Priority Data

May 14, 2014 (JP) ..... 2014-100050

(51) Int. Cl.
*B22D 11/128* (2006.01)
*B22D 11/16* (2006.01)
(Continued)

(52) U.S. Cl.
CPC ..... *B22D 11/041* (2013.01); *B21B 1/04* (2013.01); *B22D 11/1206* (2013.01);
(Continued)

(58) Field of Classification Search
CPC ..... B22D 11/1206; B22D 11/1282; B22D 11/1287
(Continued)

(56) References Cited

U.S. PATENT DOCUMENTS 6,102,101 A * 8/2000 Hanazaki ..... B22D 11/1206 164/154.1
7,086,450 B2 * 8/2006 Hiraki ..... B22D 11/00 164/417
(Continued)

FOREIGN PATENT DOCUMENTS

EP 1 050 355 11/2000
EP 1050355 A2 * 11/2000 ..... B22D 11/1206
(Continued)

OTHER PUBLICATIONS

EPO machine translation of EP 1050355 A2 (Year: 2000).*

*Primary Examiner* — Kevin E Yoon
(74) *Attorney, Agent, or Firm* — Clark & Brody

(57) ABSTRACT

A primary object of this invention is to provide a continuous casting method by which a slab of excellent internal quality can be obtained even if the casting speed is changed. In this invention, upon continuous casting with two pairs of the reduction rolls arranged along a casting direction and support rolls arranged between the reduction rolls, when a casting speed is reduced compared to a state where combination of reduction with reduction rolls at a first stage on an unsolidified portion of the slab and reduction with reduction rolls at a second stage on a solidified portion thereof is employed, the combination is switched to combination of reduction with the reduction rolls at the first stage on a portion of the slab at an end of solidification and the reduction with the reduction rolls at the second stage on the solidified portion thereof.

1 Claim, 5 Drawing Sheets

(51) Int. Cl.

| | |
|---|---|
| ***B22D 11/041*** | (2006.01) |
| ***B21B 1/04*** | (2006.01) |
| ***B22D 11/12*** | (2006.01) |
| *B21B 1/02* | (2006.01) |
| *B21B 1/46* | (2006.01) |

(52) U.S. Cl.
CPC ..... *B22D 11/1282* (2013.01); *B22D 11/16* (2013.01); *B21B 1/026* (2013.01); *B21B 1/463* (2013.01); *B21B 2001/028* (2013.01); *B21B 2201/14* (2013.01)

(58) Field of Classification Search
USPC ..... 164/441, 442, 448, 476, 484
See application file for complete search history.

(56) References Cited

U.S. PATENT DOCUMENTS

| | | | | |
|---|---|---|---|---|
| 8,245,760 | B2 * | 8/2012 | Yim ..... | B22D 11/1206 164/417 |
| 2004/0026066 | A1 | 2/2004 | Rahmfeld et al. | |

FOREIGN PATENT DOCUMENTS

| | | | | |
|---|---|---|---|---|
| JP | 63-024761 | B | | 5/1988 |
| JP | 03-124352 | | | 5/1991 |
| JP | 03124352 | A | * | 5/1991 |
| JP | 4-37456 | A | | 2/1992 |
| JP | 2007-296542 | A | | 11/2007 |
| JP | 4296985 | B | | 4/2009 |
| JP | 4813817 | B | | 9/2011 |

* cited by examiner

METHOD FOR CONTINUOUS-CASTING SLAB

TECHNICAL FIELD

This invention relates to a method for continuous-casting a slab, and particularly, relates to a method for continuous-casting a slab by which a slab of excellent internal quality can be manufactured.

BACKGROUND ART

When a continuous casting slab is rolled to manufacture a heavy gauge steel plate, it is important to reduce centerline segregation and the central porosity volume: such centerline segregation and central porosity form in the central part of the continuous casting slab in the thickness direction. Thus, reduction is carried out on the slab inside and outside a continuous casting machine in order to improve the internal quality of the slab. A heavy gauge steel plate that is obtained by rolling a slab of excellent internal quality as a material is of excellent internal quality. Formation of internal defects caused by central porosity is checked in such a heavy gauge steel plate.

The following are conventional arts of reduction on a slab: Japanese Patent No. 1480540 (Patent Literature 1) discloses the art of carrying out heavy reduction on the central part and both side parts of a slab in order with convex rolls and flat rolls arranged more downstream than a slab cutting machine of a continuous casting machine.

In the art described in Patent Literature 1, the efficiency of the reduction is decreasing as surface temperature of the slab is falling because the reduction is carried out outside the continuous casting machine. Thus, it is necessary to maintain reduction force and to heavily invest in plant and equipment.

Japanese Patent No. 4296985 (Patent Literature 2) discloses the art of rolling-reducing the center part of a cast slab in width by 3 to 15 mm when the solid-phase ratio at the center of the cast slab in the thickness direction is 0.80 or more after bulging the cast slab by 2 to 20 mm in a continuous caster. Japanese Patent No. 4813817 (Patent Literature 3) discloses the art of specifying temperature at the center part of a slab when rolling-reduction is started at a completely solidified place of the slab and temperature on the slab surface when the rolling-reduction is ended upon the rolling-reduction on the slab in continuous casting, and making the rolling-reduction quantity X when difference between the surface temperature at the end of the rolling-reduction and the temperature at the center at the start of the rolling-reduction is 600° C., to be a predetermined quantity or more. Japanese Laid-open Patent Publication No. 2007-296542 (Patent Literature 4) discloses the art of specifying the relation between the rolling-reduction amount and the center porosity volume of a cast slab when the slab at the end of solidification is rolling-reduced as a whole using one pair of upper and lower rolling-reduction rolls disposed in the end of a continuous casting machine. Japanese Laid-open Patent Publication No. H4-37456 (Patent Literature 5) discloses the art of continuously disposing two or three stages of reduction rolls of twice to five times as much as the thickness of a slab in diameter, and setting the reduction rate of the reduction rolls at the first stage in 1.5 to 4.0% and the reduction rate of the reduction rolls at each second and third stage in 2.0 to 4.5%.

CITATION LIST

Patent Literature

Patent Literature 1: JP 1480540B
Patent Literature 2: JP 4296985B
Patent Literature 3: JP 4813817B
Patent Literature 4: JP 2007-296542A
Patent Literature 5: JP H4-37456A

SUMMARY OF INVENTION

Technical Problem

Conventionally, in a process of reduction using large diameter reduction rolls within a continuous casting machine in order to improve the internal quality of a slab, the solid-phase ratio at a reduction position of the slab is rectified by adjusting casting conditions (especially the casting speed) in every case of reduction on a portion including an unsolidified part, reduction on a portion at the end of solidification and reduction on a solidified portion of the slab. Thus, there arises a problem that if a position where reduction is carried out on a slab is fixed in a continuous casting machine, reduction as intended cannot be carried out when the casting speed changes. For example, it is inevitable that the casting speed reduces when the last slab of continuous casting is cast.

Against this problem, such a measure can be considered that a reduction position with large diameter reduction rolls is set at the most downstream side in the casting direction (the endmost of a continuous casting machine), and continuous casting is carried out at the critical casting speed for the machine length (the maximum casting speed achievable in the continuous casting machine), to check the reduction of the productivity of a slab. However, sometimes it is difficult to set a reduction position with large diameter reduction rolls at the endmost of a continuous casting machine and to rectify the solid-phase ratio of a slab at this reduction position in view of the casting speed and cooling conditions of the slab. Therefore, this measure is not always effective.

Against this problem, the arts of Patent Literatures 2 to 4 just specify the solid-phase ratio at the center of the cast slab in the thickness direction upon the reduction, and surface temperature and temperature at the center of the slab, but do not consider or examine arrangement of reduction equipment such as large diameter reduction rolls. Therefore, even if any of these arts is used, it is impossible to continuous-cast a slab of excellent internal quality when the casting speed changes.

In the art of Patent Literature 5, reduction rolls twice to five times as much as the thickness of the slab in diameter are continuously arranged. In this case, intervals between adjacent reduction rolls in the casting direction are long, and bulging occurring in the vicinity of a finally solidified place of the slab badly affects the internal quality of the slab manufactured in non-heavy reduction operation. Therefore, it is not practical to apply this art to a continuous casting machine for general-purpose plates which is frequently used for casting a slab of wide width and large cross-section.

This invention was made in view of these problems. An object of this invention is to provide a continuous casting method for carrying out reduction on a slab in a continuous casting machine, and by which the slab of excellent internal quality can be continuous-cast even if the casting speed is changed.

Solution to Problem

A first aspect of this invention is a method for continuous-casting a slab while reduction is carried out on the slab using a continuous casting machine with two stages of reduction rolls, each of the two stages consisting of a pair of the reduction rolls, and being arranged along a casting direction, a diameter of each of the reduction rolls being 1.2 to 2.0 times as much as thickness of the slab just before reduction with corresponding reduction rolls, the continuous casting machine including the reduction rolls and support rolls, the support rolls being arranged between said two stages of the reduction rolls, wherein when a casting speed is reduced compared to a state where the slab is cast at a constant speed under combination of reduction with reduction rolls at a first stage on an unsolidified portion of the slab, a solid-phase ratio of the unsolidified portion at a center of the slab in a thickness direction being less than 0.8, and reduction with reduction rolls at a second stage on a solidified portion of the slab, a solid-phase ratio of the solidified portion at the center of the slab in the thickness direction being 1.0, the reduction rolls at the second stage being arranged more downstream than the reduction rolls of the first stage in the casting direction; accompanying movement of a place of the slab where the solidification is ended upstream in the casting direction due to the reduction of the casting speed, the combination is switched to combination of reduction with the reduction rolls at the first stage on a portion of the slab at an end of solidification, a solid-phase ratio of the portion at the center of the slab in the thickness direction being no less than 0.8 and less than 1.0, and reduction with the reduction rolls at the second stage on the solidified portion of the slab, the solid-phase ratio of the solidified portion at the center of the slab in the thickness direction being 1.0.

In this invention, "reduction rolls" are referred to as rolls relating to heavy reduction, and "support rolls" are referred to as rolls not relating to heavy reduction. "Heavy reduction" is a method for carrying out reduction on a slab when unsolidified molten steel is forcibly sent out upstream or in a state at a high solid-phase ratio where no flow of molten steel occurs, differently from light reduction, where intervals between support rolls are set for the purpose of checking slab bulging at the end of solidification and the flow of molten steel due to solidification shrinkage or the like.

A second aspect of this invention is a method for continuous-casting a slab while reduction is carried out on the slab using a continuous casting machine with two stages of reduction rolls, each of the two stages consisting of a pair of the reduction rolls, and being arranged along a casting direction, a diameter of each of the reduction rolls being 1.2 to 2.0 times as much as thickness of the slab just before reduction with corresponding reduction rolls, the continuous casting machine including the reduction rolls and support rolls, the support rolls being arranged between said two stages of the reduction rolls, wherein when a casting speed is reduced compared to a state where the slab is cast at a constant speed while reduction is carried out on the slab with reduction rolls at a second stage; accompanying movement of a place of the slab where solidification is ended upstream in the casting direction due to the reduction of the casting speed, the reduction with the reduction rolls at the second stage is switched to reduction with reduction rolls at a first stage, the reduction rolls at the first stage being arranged more upstream than the reduction rolls at the second stage in a casting direction, at a casting speed where a reduction amount of the reduction rolls at the second stage, which are used for the reduction on the slab, is same as that of the reduction rolls at the first stage.

A third aspect of this invention is a method for continuous-casting a slab while reduction is carried out on the slab using a continuous casting machine with two stages of reduction rolls, each of the two stages consisting of a pair of the reduction rolls, and being arranged along a casting direction, a diameter of each of the reduction rolls being 1.2 to 2.0 times as much as thickness of the slab just before reduction with corresponding reduction rolls, the continuous casting machine including the reduction rolls and support rolls, the support rolls being arranged between said two stages of the reduction rolls, wherein when a casting speed is increased compared to a state where the slab is cast at a constant speed under combination of reduction with reduction rolls at a first stage on a portion of the slab at an end of solidification, a solid-phase ratio of the portion at a center of the slab in a thickness direction being no less than 0.8 and less than 1.0, and reduction with reduction rolls at a second stage on a solidified portion of the slab, a solid-phase ratio of the solidified portion at the center of the slab in the thickness direction being 1.0, the reduction rolls at the second stage being arranged more downstream than the reduction rolls of the first stage in the casting direction; accompanying movement of a place of the slab where the solidification is ended downstream in the casting direction due to the increase of the casting speed, the combination is switched to combination of reduction with the reduction rolls at the first stage on an unsolidified portion of the slab, a solid-phase ratio of the unsolidified portion at the center of the slab in the thickness direction being less than 0.8, and reduction with the reduction rolls at the second stage on the solidified portion of the slab, the solid-phase ratio of the solidified portion at the center of the slab in the thickness direction being 1.0.

A fourth aspect of this invention is a method for continuous-casting a slab while reduction is carried out on the slab using a continuous casting machine with two stages of reduction rolls, each of the two stages consisting of a pair of the reduction rolls, and being arranged along a casting direction, a diameter of each of the reduction rolls being 1.2 to 2.0 times as much as thickness of the slab just before reduction with corresponding reduction rolls, the continuous casting machine including the reduction rolls and support rolls, the support rolls being arranged between said two stages of the reduction rolls, wherein when a casting speed is increased compared to a state where the slab is cast at a constant speed while reduction is carried out on the slab with reduction rolls at a first stage; accompanying movement of a place of the slab where solidification is ended downstream in the casting direction due to the increase of the casting speed, the reduction with the reduction rolls at the first stage is switched to reduction with reduction rolls at a second stage, the reduction rolls at the second stage being arranged more downstream than the reduction rolls at the first stage in a casting direction, at a casting speed where a reduction amount of the reduction rolls at the first stage, which are used for the reduction on the slab, is same as that of the reduction rolls at the second stage.

Advantageous Effects of Invention

According to the method for continuous-casting a slab of this invention, a slab of excellent internal quality can be obtained even if the casting speed changes. In addition, the cost of equipment can be held down because large diameter reduction rolls that are arranged in a continuous casting machine are used.

DESCRIPTION OF EMBODIMENTS

The embodiments of this invention will be described hereinafter. The embodiments described below are examples of this invention but do not limit this invention.

1. Basic Structure of Continuous Casting Machine

Figure 1:
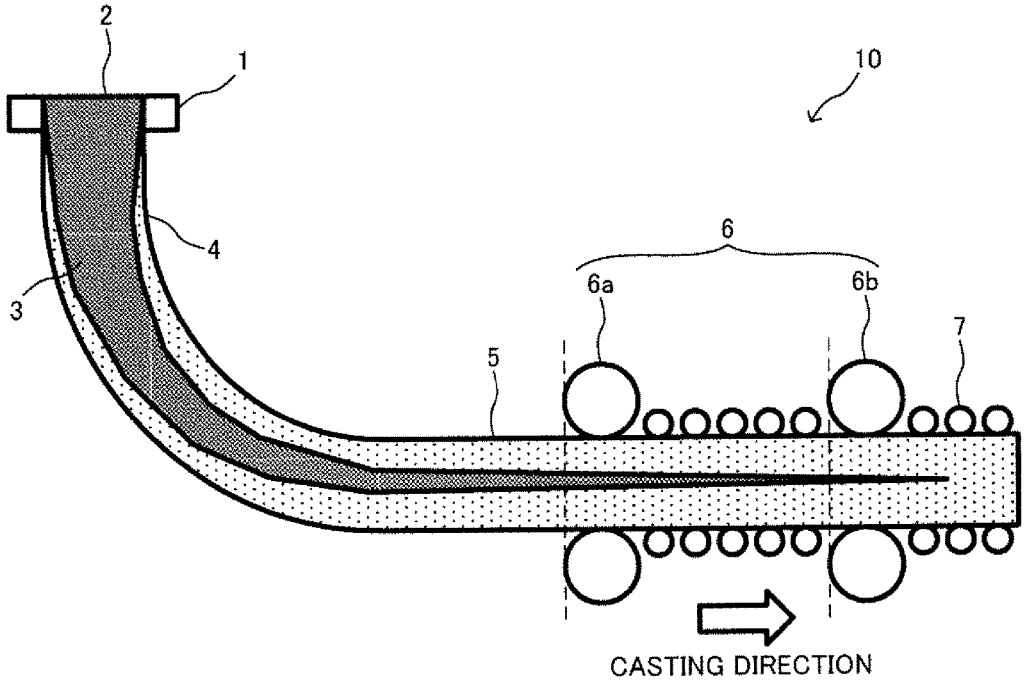
FIG. 1 shows a structure of a continuous casting machine to which the method for continuous-casting a slab of this invention can be applied, in a state where reduction is not carried out on a slab.

FIG. 1 shows a structure of a continuous casting machine 10 to which the method for continuous-casting a slab of this invention can be applied, in a state where reduction is not carried out on a slab. Molten steel 3 poured into a mold 1 so as to form a molten steel bath surface (meniscus) 2 is cooled by water spray (secondary cooling water) jetting out from the mold 1 and a group of secondary cooling spray nozzles that was not shown and was under the mold 1, to form a solidified shell 4, to be a slab 5. The slab 5 is withdrawn as keeping the molten steel 3 that is unsolidified in its inside, and reduction is appropriately carried out on the slab 5 with plural pairs of large diameter reduction rolls 6. The slab 5 on which the reduction has been carried out with the large diameter reduction rolls 6 passes through support rolls 7 that are arranged between the large diameter reduction rolls 6 and also more downstream than the large diameter reduction rolls 6 in the casting direction, and is withdrawn with pinch rolls that are not shown. FIG. 1 shows the casting direction using an arrow.

The large diameter reduction rolls 6 shown in FIG. 1 are constituted by two stages arranged along the casting direction: each stage consists of a pair of large diameter reduction rolls. Hereinafter each pair of the large diameter reduction rolls is referred to as first large diameter reduction rolls 6*a* and second large diameter reduction rolls 6*b* in order from the upstream side in the casting direction. Diameter of each first large diameter reduction rolls 6*a* is 1.2 to 2.0 times as much as the thickness of the slab 5 just before reduction is carried out thereon with the first large diameter reduction rolls 6*a*. Diameter of each second large diameter reduction rolls 6*b* is 1.2 to 2.0 times as much as the thickness of the slab 5 just before reduction is carried out thereon with the second large diameter reduction rolls 6*b*. Here, the reason why the lower limit of each diameter of the first large diameter reduction rolls 6*a* and the second large diameter reduction rolls 6*b* is 1.2 times as much as the thickness of the slab just before the reduction with corresponding large diameter reduction rolls is to maintain reduction force necessary to obtain the slab of excellent internal quality. On the other hand, the reason why the upper limit of each diameter of the first large diameter reduction rolls 6*a* and the second large diameter reduction rolls 6*b* is twice as much as the thickness of the slab just before the reduction with corresponding large diameter reduction rolls is to check the increase of the cost of equipment and bulging between rolls.

The support rolls 7 are arranged between the large diameter reduction rolls 6 in the continuous casting machine 10. Therefore, even if intervals between the large diameter reduction rolls 6 are long, bulging is hard to occur in the slab 5, and it is possible to check deterioration of the internal quality of the slab 5.

2. Method for Continuous-Casting Slab of this Invention

In the method for continuous-casting a slab of this invention, reduction is carried out on the slab 5 with two stages of the large diameter reduction rolls 6 that are arranged along the casting direction within the continuous casting machine 10. The large diameter reduction rolls 6 are large diameter reduction rolls 1.2 to 2.0 times as much as the thickness of the slab 5 just before each case of reduction therewith. Here, the reduction on the slab with the large diameter reduction rolls is referred to as "heavy reduction".

Figure 2:
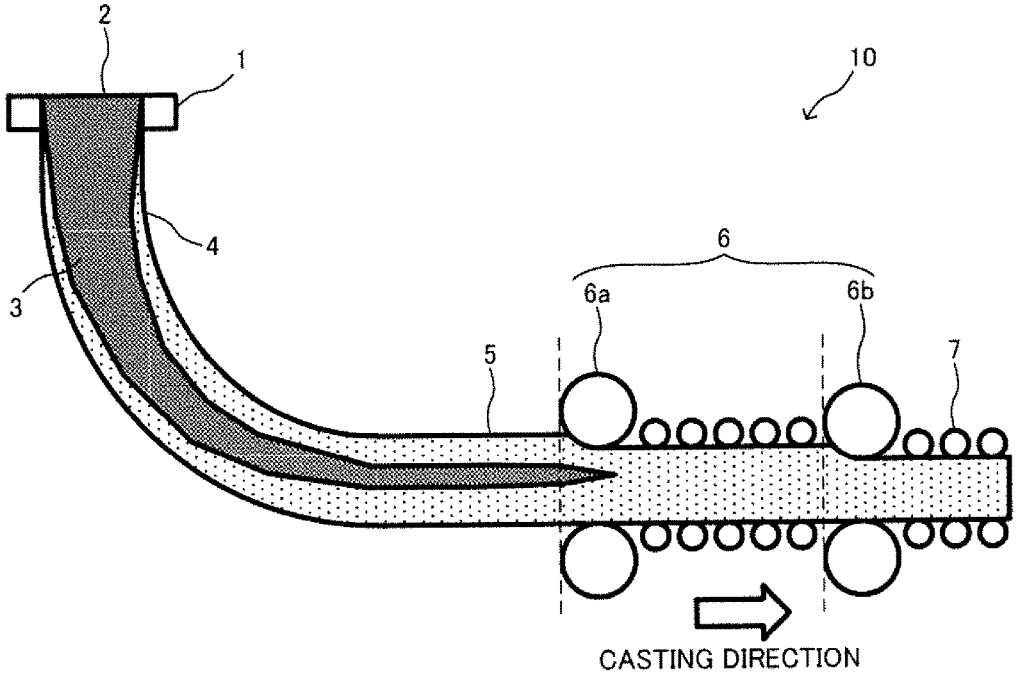
FIG. 2 shows a structure of a continuous casting machine to which the method for continuous-casting a slab of this invention can be applied, in a state where reduction is carried out on a slab with the large diameter reduction rolls in both upstream side and downstream side in the casting direction.
Figure 3:
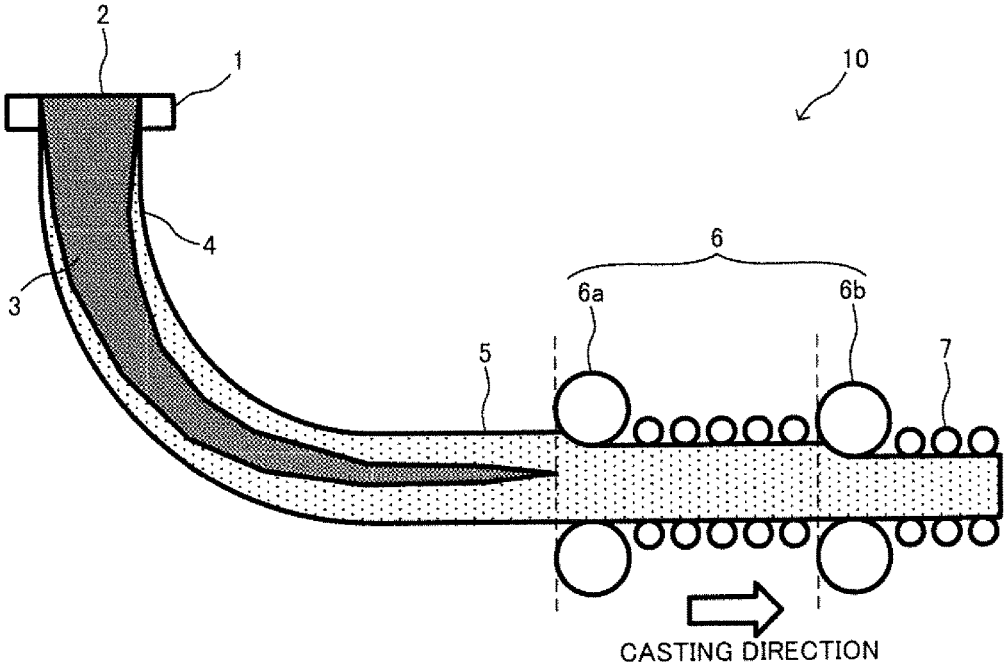
FIG. 3 shows a structure of a continuous casting machine to which the method for continuous-casting a slab of this invention can be applied, in a state where reduction is carried out on a slab with the large diameter reduction rolls in both upstream side and downstream side in the casting direction.
Figure 4:
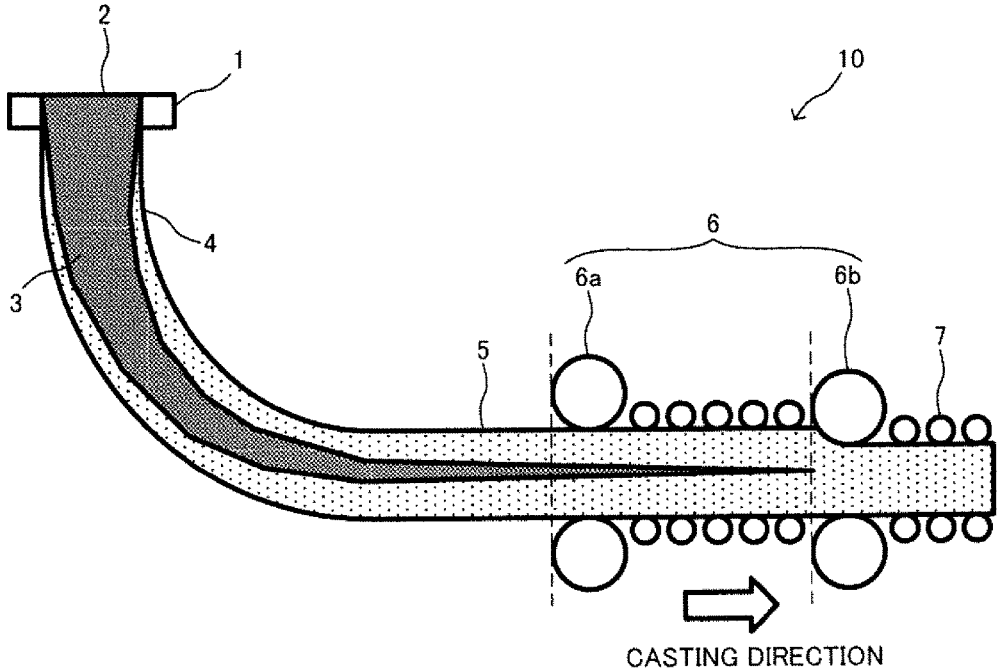
FIG. 4 shows a structure of a continuous casting machine to which the method for continuous-casting a slab of this invention can be applied, in a state where reduction is carried out on a slab only with the large diameter reduction rolls in the downstream side in the casting direction.
Figure 5:
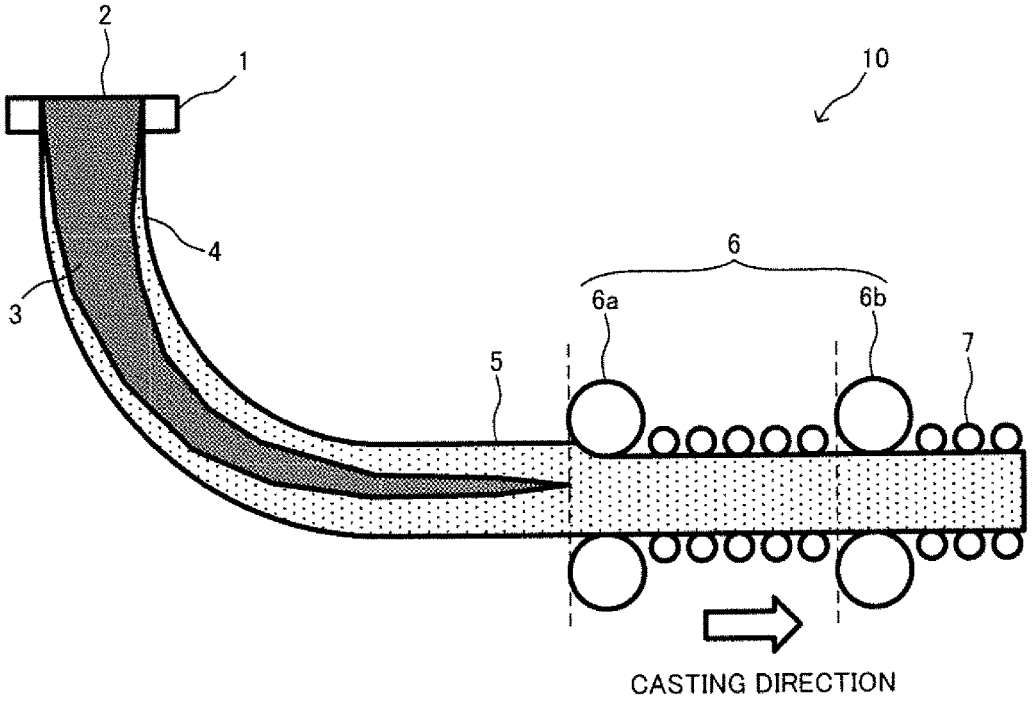
FIG. 5 shows a structure of a continuous casting machine to which the method for continuous-casting a slab of this invention can be applied, in a state where reduction is carried out on a slab only with the large diameter reduction rolls in the upstream side in the casting direction.

FIGS. 2 to 5 show structures of a continuous casting machine to which the method for continuous-casting a slab of this invention can be applied. FIGS. 2 and 3 show the state where the reduction is carried out on the slab with the large diameter reduction rolls in both upstream side and downstream side in the casting direction. FIG. 4 shows the state where the reduction is carried out on the slab only with the large diameter reduction rolls in the downstream side in the casting direction. FIG. 5 shows the state where the reduction is carried out on the slab only with the large diameter reduction rolls in the upstream side in the casting direction.

As shown in FIGS. 1 to 5, when two stages of the large diameter reduction rolls 6 are used, Cases 1 to 5 presented in Table 1 below show the combinations of a state of solidification of the slab at the position where heavy reduction is carried out and whether or not the reduction is carried out.

TABLE 1

| Case | First Large Diameter Reduction Rolls | Second Large Diameter Reduction Rolls | Corresponding Drawing |
|---|---|---|---|
| 1 | No Reduction | No Reduction | FIG. 1 |
| 2 | Reduction on Unsolidified | Reduction after Solidified | FIG. 2 |
| 3 | Reduction at End of Solidification | Reduction after Solidified | FIG. 3 |
| 4 | No Reduction | Reduction at End of Solidification | FIG. 4 |
| 5 | Reduction at End of Solidification | No Reduction | FIG. 5 |
| 6 | Reduction at End of Solidification | Reduction after Solidified | FIG. 3 |

TABLE 1-continued

| Case | First Large Diameter Reduction Rolls | Second Large Diameter Reduction Rolls | Corresponding Drawing |
|---|---|---|---|
| 7 | Reduction on Unsolidified | Reduction after Solidified | FIG. 2 |
| 8 | Reduction at End of Solidification | No Reduction | FIG. 5 |
| 9 | No Reduction | Reduction at End of Solidification | FIG. 4 |

In the above Table 1, "Reduction on Unsolidified", "Reduction at End of Solidification" and "Reduction after Solidified" mean, as presented in Table 2 below, reduction with the large diameter reduction rolls 6 on places of the slab 5 where the solid-phase ratio at the center of the slab 5 in the thickness direction (hereinafter also referred to as "center solid-phase ratio") is "less than 0.8", "no less than 0.8 and less than 1.0" and "1.0" respectively.

TABLE 2

| Type of Reduction | Center Solid-phase Ratio |
|---|---|
| Reduction on Unsolidified | less than 0.8 |
| Reduction at End of Solidification | no less than 0.8 and less than 1.0 |
| Reduction after Solidified | 1.0 |

Case 1 corresponds to FIG. 1, which is a case where no reduction is carried out on the slab 5 with any of the first large diameter reduction rolls 6*a* and the second large diameter reduction rolls 6*b*.

Cases 2, 3, 6 and 7 correspond to FIGS. 2 and 3, which are cases where the reduction is carried out on the slab 5 with the first large diameter reduction rolls 6*a* but no reduction is carried out with the second large diameter reduction rolls 6*b*. In Cases 2 and 7 among these cases, the reduction is carried out on a place of an unsolidified portion of the slab 5 (a portion where the center solid-phase ratio is less than 0.8) with the first large diameter reduction rolls 6*a*. On the other hand, in Cases 3 and 6, the reduction is carried out on a place of a portion at the end of solidification of the slab 5 (a portion where the center solid-phase ratio is no less than 0.8 and less than 1.0) with the first large diameter reduction rolls 6*a*.

Cases 4 and 9 correspond to FIG. 4, which are cases where the reduction is carried out on the place of the portion at the end of solidification of the slab 5 (the portion where the center solid-phase ratio is no less than 0.8 and less than 1.0) with the second large diameter reduction rolls 6*b* while no reduction is carried out on the slab 5 with the first large diameter reduction rolls 6*a*.

Cases 5 and 8 correspond to FIG. 5, which are cases where the reduction is carried out on the place of the portion at the end of solidification of the slab 5 (the portion where the center solid-phase ratio is no less than 0.8 and less than 1.0) with the first large diameter reduction rolls 6*a* while no reduction is carried out on the slab 5 with the second large diameter reduction rolls 6*b*.

The method for continuous-casting a slab of this invention includes the following two embodiments:

(1) A method for continuous-casting a slab wherein upon continuous-casting the slab 5 using the continuous casting machine 10 as carrying out the reduction on the slab 5 with the large diameter reduction rolls 6, a manner of the reduction on the slab 5 is switched from Case 2 to Case 3 when the casting speed is reduced compared to the state where the slab 5 is cast at a constant speed as carrying out the reduction on the slab 5 in Case 2, accompanying the movement of the place of the slab 5 where solidification is ended, to the upstream side in the casting direction, due to the reduction of the casting speed; and (2) A method for continuous-casting a slab wherein upon continuous-casting the slab 5 using the continuous casting machine 10 as carrying out the reduction on the slab 5 with the large diameter reduction rolls 6, a manner of the reduction on the slab 5 is switched from Case 4 to Case 5 at the casting speed where the reduction amount of the first large diameter reduction rolls 6*a* is same as that of the second large diameter reduction rolls 6*b* in Case 4 when the casting speed is reduced compared to the state where the slab is cast at a constant speed as carrying out the reduction on the slab 5 in Case 4, accompanying the movement of the place of the slab 5 where solidification is ended, to the upstream side in the casting direction, due to the reduction of the casting speed.

In the method for continuous-casting a slab of this invention, the heavy reduction is carried out on plural places in combination according to a state of solidification of the slab. Therefore, the slab of excellent internal quality can be stably obtained even if heavy reduction operation accompanied by the reduction of the casting speed is carried out.

2-1. Preferred Embodiment of Method for Continuous-Casting Slab of this Invention (1)

In the method for continuous-casting a slab of this invention, when continuous casting is carried out in the embodiment shown in FIG. 2, preferably, the reduction is carried out on an unsolidified portion of the slab 5 where the center solid-phase ratio is no less than 0.2, with the first large diameter reduction rolls 6*a* by 5 to 30 mm, and the reduction is carried out on the solidified portion of the slab 5 with the second large diameter reduction rolls 6*b* by 1 to 15 mm.

2-2. Preferred Embodiment of Method for Continuous-Casting Slab of this Invention (2)

In the method for continuous-casting a slab of this invention, when continuous casting is carried out in the embodiment shown in FIG. 3, preferably, the reduction is carried out on the portion of the slab 5 at the end of solidification with the first large diameter reduction rolls 6*a* by 5 to 20 mm, and the reduction is carried out on the solidified portion of the slab 5 with the second large diameter reduction rolls 6*b* by 1 to 15 mm.

The above description concerning this invention mentions the embodiments of: (1) the manner of the reduction on the slab 5 is switched from Case 2 to Case 3; and (2) the manner of the reduction on the slab 5 is switched from Case 4 to Case 5, accompanying the movement of the place of the slab 5 where solidification is ended, to the upstream side in the casting direction, due to the reduction of the casting speed. Other than these embodiments, this invention can include embodiments of: (3) a manner of the reduction on the slab 5 is switched from Case 6 to Case 7; and (4) a manner of the reduction on the slab 5 is switched from Case 8 to Case 9, accompanying the movement of the place of the slab 5 where solidification is ended, to the downstream side in the casting direction, due to the increase of the casting speed. Even in these embodiments, heavy reduction is carried out on plural places in combination according to a state of solidification of the slab. Thus, the slab of excellent internal quality can be stably obtained even if heavy reduction operation accompanied by increase of the casting speed is carried out.

EXAMPLES

The following continuous casting tests were carried out in order to confirm the effect of the method for continuous-casting a slab of this invention, and their results were evaluated.

A vertical bending-type continuous casting machine shown in FIGS. 1 to 5 was used as a continuous casting machine. A slab continuous-cast was made of steel of 0.16 mass % C content, 280 to 300 mm in thickness and 2300 mm in width. The casting speed was 0.58 to 0.80 m/min. Secondary cooling was carried out under the condition of 0.78 to 0.94 L/kg-steel in specific water amount.

The first large diameter reduction rolls were arranged at a position 21.2 m away from the molten steel bath surface in the mold downstream in the casting direction. The second large diameter reduction rolls were arranged at a position 27.0 m away from the molten steel bath surface in the mold downstream in the casting direction. Each diameter of the first large diameter reduction rolls and the second large diameter reduction rolls was 1.2 to 2.0 times as much as the thickness of the slab just before corresponding reduction.

The reduction on the slab was started after the tip of the slab had passed through a position of the large diameter reduction rolls.

Evaluation categories included "Index of Internal Quality of Slab" and "Evaluation of Internal Quality of Slab".

"Index of Internal Quality of Slab" was a ratio of the central porosity volume of a slab that was used as the basis (hereinafter may be referred to as "base material") to the central porosity volume of the slab cast in each test.

Here, the central porosity volume of a slab was a specific volume of the central porosity calculated from a specific gravity at the central part in the thickness direction on the basis of the average specific gravity of the slab at its position of ¼ in thickness where it was assumed to be almost no central porosity formed. That is, the central porosity volume was defined by the following formula (1):

$$Vp=1/\rho-1/\rho_0 \quad (1)$$

wherein Vp ($cm^3/g$) represented the central porosity volume, $\rho$ ($g/cm^3$) represented the average specific gravity at the center of the thickness of a slab, and $\rho_0$ ($g/cm^3$) represented the average specific gravity of a slab at its position of ¼ in thickness.

"Evaluation of Internal Quality of Slab" was evaluation of the index of the internal quality of a slab (the index of the base material was 1.0, which was the basis), and was represented by symbols of ◎ and ○. The meaning of each symbol was as follows:

◎ (excellent): the index of the internal quality of a slab was large, which exceeded 3.0.

○ (good): the index of the internal quality of a slab was more than 1.0 and less than 3.0.

Tests were carried out on the following kinds of steel presented in Table 3 under the conditions presented in the following Table 4. In Table 4, "Case" means the combinations of a state of solidification of the slab at the position where heavy reduction was carried out and whether or not the reduction was carried out, which are presented in the above Table 1. Table 4 also presents the reduction amount of the slab with the large diameter reduction rolls and the casting speed. The reduction amount of the slab was calculated from difference between an interval of the large diameter reduction rolls and an interval of a support roll that was adjacent to a large diameter reduction roll upstream in the casting direction.

TABLE 3

| Chemical Component (mass %) | | | | | | |
|---|---|---|---|---|---|---|
| C | Si | Mn | P | S | Ni | Al |
| 0.16 | 0.18 | 0.93 | 0.016 | 0.003 | 0.01 | 0.026 |

TABLE 4

| Item | Case | Reduction Amount with Rolls [mm] (Center Solid-phase Ratio upon Reduction) 1st Large Diameter Reduction Rolls | 2nd Large Diameter Reduction Rolls | Idx. of Internal Quality of Slab | Evaluation of Internal Quality of Slab | Casting Speed [m/min] |
|---|---|---|---|---|---|---|
| Comparison Ex. 1 | 1 | — | — | 1.0 | Basis | 0.80 |
| Ex. of This Invention 1 | 2 | 32 (0.05) | 5 (1.0) | 3.2 | ◎ | 0.80 |
| | 3 | 12 (0.9) | 5 (1.0) | 3.8 | ◎ | 0.58 |
| Ex. of This Invention 2 | 4 | — | 12 (0.9) | 1.7 | ○ | 0.80 |
| | 5 | 12 (0.9) | — | 2.5 | ○ | 0.58 |
| Ex. of This Invention 3 | 6 | 12 (0.9) | 5 (1.0) | 3.8 | ◎ | 0.58 |
| | 7 | 32 (0.05) | 5 (1.0) | 3.2 | ◎ | 0.80 |
| Ex. of This Invention 4 | 8 | 12 (0.9) | — | 2.5 | ○ | 0.58 |
| | 9 | — | 12 (0.9) | 1.7 | ○ | 0.80 |

The above Table 4 presents the index of internal quality of a slab and evaluation of internal quality of a slab together with the test conditions. For the index of internal quality of a slab, the slab of Comparative Example 1 was used as the base material. In Comparative Example 1, any of the first large diameter reduction rolls and the second large diameter reduction rolls were not used for the reduction on the slab (Case 1).

In Example 1 of this invention, both two stages of the large diameter reduction rolls were used for the reduction on the slab. While the casting speed was constant at 0.80 m/min. reduction on the unsolidified was carried out with the first large diameter reduction rolls and reduction after solidified was carried out with the second large diameter reduction rolls (Case 2). The index of internal quality of a slab as a result was 3.2. The slab of excellent internal quality was able to be obtained.

In Example 1 of this invention, after that, the place where solidification was ended moved upstream in the casting direction due to reduction of the casting speed, so that the reduction with the first large diameter reduction rolls became reduction at the end of solidification (Case 3). Accompanying this, the reduction amount of the first large diameter reduction rolls decreased from 32 mm to 12 mm. After the casting speed reduced to 0.58 m/min, both two stages of the large diameter reduction rolls were used for the reduction on the slab as well, and the reduction at the end of solidification was carried out with the first large diameter reduction rolls and the reduction after solidified was carried out with the second large diameter reduction rolls (Case 3). As a result, the index of internal quality of a slab was 3.8, which was the maximum level. Even when the casting speed reduced, the slab of very excellent internal quality was able to be obtained.

In Example 2 of this invention, only the second large diameter reduction rolls among two stages of the large diameter reduction rolls were used for the reduction on the slab. While the casting speed was constant at 0.80 m/min, the reduction at the end of solidification was carried out (Case 4). The index of internal quality of a slab as a result was 1.7, which was good.

In Example 2 of this invention, after that, the place where solidification was ended moved upstream in the casting direction due to reduction of the casting speed. After the casting speed reduced to 0.58 m/min, only the first large diameter reduction rolls were used for the reduction on the slab, and the reduction at the end of solidification was carried out (Case 5). The reduction amounts of both Cases 4 and 5 were same, which was 12 mm. As a result, the index of internal quality of a slab was 2.5. Even when the casting speed reduced, the slab of very excellent internal quality was able to be obtained.

In Example 3 of this invention, both two stages of the large diameter reduction rolls were used for the reduction on the slab. While the casting speed was constant at 0.58 m/min, the reduction at the end of solidification was carried out with the first large diameter reduction rolls and the reduction after solidified was carried out with the second large diameter reduction rolls (Case 6). The index of internal quality of a slab as a result was 3.8. The slab of excellent internal quality was able to be obtained.

In Example 3 of this invention, after that, the place where solidification was ended moved downstream in the casting direction due to the increase of the casting speed, so that the reduction with the first large diameter reduction rolls became the reduction on the unsolidified (Case 7). Accompanying this, the reduction amount of the first large diameter reduction rolls increased from 12 mm to 32 mm. After the casting speed increased to 0.80 m/min, both two stages of the large diameter reduction rolls were used for the reduction on the slab as well, and the reduction on the unsolidified was carried out with the first large diameter reduction rolls, and the reduction after solidified was carried out with the second large diameter reduction rolls (Case 7). As a result, the index of internal quality of a slab was 3.2. Even when the casting speed increased, the slab of excellent internal quality was able to be obtained.

In Example 4 of this invention, only the first large diameter reduction rolls among two stages of the large diameter reduction rolls were used for the reduction on the slab. While the casting speed was constant at 0.58 m/min, the reduction at the end of solidification was carried out (Case 8). The index of internal quality of a slab as a result was 2.5, which was good.

In Example 4 of this invention, after that, the place where solidification was ended moved downstream in the casting direction due to increase of the casting speed. After the casting speed increased to 0.80 m/min, only the second large diameter reduction rolls were used for the reduction on the slab, and the reduction at the end of solidification was carried out (Case 9). The reduction amounts of both Cases 8 and 9 were same, which was 12 mm. As a result, the index of internal quality of a slab was 1.7. Even when the casting speed increased, the slab of very excellent internal quality was able to be obtained.

INDUSTRIAL APPLICABILITY

According to the method for continuous-casting a slab of this invention, a slab of good internal quality can be obtained even if the casting speed changes. Therefore, even if slabs of different materials and for different purposes are cast in the same continuous casting machine, the slabs of good internal quality can be obtained. In addition, the cost of equipment can be held down because large diameter reduction rolls that are arranged in a continuous casting machine are used.

REFERENCE SIGNS LIST

1: mold, 2: molten steel bath surface (meniscus), 3: molten steel, 4: solidified shell, 5: slab, 6: large diameter reduction rolls, **6*a*: first large diameter reduction rolls, 6*b*: second large diameter reduction rolls, 7: support rolls, 10**: continuous casting machine

The invention claimed is:

1. A method for continuous-casting a slab while reduction is carried out on the slab using a continuous casting machine with two stages of reduction rolls, each of the two stages consisting of a pair of the reduction rolls, and being arranged along a casting direction, a diameter of each of the reduction rolls being 1.2 to 2.0 times as much as thickness of the slab just before reduction with corresponding reduction rolls, the continuous casting machine including the reduction rolls and support rolls, the support rolls being arranged between said two stages of the reduction rolls, the method comprising:

reducing a casting speed compared to a state where the slab is cast at a constant speed under combination of reduction with reduction rolls at a first stage on an unsolidified portion of the slab, a solid-phase ratio of the unsolidified portion at a center of the slab in a thickness direction being less than 0.8, and reduction with reduction rolls at a second stage on a solidified portion of the slab, a solid-phase ratio of the solidified portion at the center of the slab in the thickness direction being 1.0, the reduction rolls at the second stage being arranged more downstream than the reduction rolls of the first stage in the casting direction; and switching the combination to a combination of reduction with the reduction rolls at the first stage on a portion of the slab at an end of solidification, a solid-phase ratio of the portion at the center of the slab in the thickness direction being no less than 0.8 and less than 1.0, with an adjusted reduction amount of the reduction rolls at the first stage, and the reduction with the reduction rolls at the second stage on the solidified portion of the slab, the solid-phase ratio of the solidified portion at the center of the slab in the thickness direction being 1.0, accompanying movement of a place of the slab where the solidification is ended upstream in the casting direction due to the reduction of the casting speed.

* * * * *